US005941425A

United States Patent [19]

Stolz

[11] Patent Number: 5,941,425

[45] Date of Patent: Aug. 24, 1999

[54] SAFETY CLOSURE CAP FOR A CONTAINER

[75] Inventor: Bernd Stolz, Neunkirchen, Germany

[73] Assignee: Heinrich Stolz GmbH & Co. KG, Neunkirchen, Germany

[21] Appl. No.: 08/894,936

[22] PCT Filed: Feb. 12, 1996

[86] PCT No.: PCT/EP96/00589

§ 371 Date: Dec. 31, 1997

§ 102(e) Date: Dec. 31, 1997

[87] PCT Pub. No.: WO96/27535

PCT Pub. Date: Sep. 12, 1996

[30] Foreign Application Priority Data

Mar. 3, 1995 [DE] Germany ..... 195 07 435

[51] Int. Cl.[6] ..... B67D 5/06

[52] U.S. Cl. ..... 222/153.14; 222/529; 222/530; 222/541.9

[58] Field of Search ..... 222/153.07, 153.14, 222/527, 528, 529, 530, 531, 532, 541.9

[56] References Cited

U.S. PATENT DOCUMENTS

| | | | |
|---|---|---|---|
| 4,422,563 | 12/1983 | Babiol | 222/529 |
| 4,442,949 | 4/1984 | Dwinell et al. | 222/527 |
| 5,078,288 | 1/1992 | Fuchs | 215/209 |
| 5,566,864 | 10/1996 | Stolz | 222/153.14 |
| 5,678,735 | 10/1997 | Guglielmini | 222/527 |

FOREIGN PATENT DOCUMENTS

| | | | |
|---|---|---|---|
| 569897 | 11/1993 | European Pat. Off. | 222/530 |
| 2340871 | 9/1977 | France . | |
| 4139896 | 6/1993 | Germany . | |
| 4209784 | 9/1993 | Germany . | |
| 603426 | 8/1978 | Switzerland . | |

*Primary Examiner*—Joseph A. Kaufman
*Attorney, Agent, or Firm*—Pauley Petersen Kinne & Fejer

[57] ABSTRACT

A container closure having a lower closure element and a closure cap disposed on a primary spout formed by the lower closure element. The closure element has a cover and, formed thereon, a cap casing with at least one shoulder. The lower closure element has at least one counter-element which cooperates with the shoulder to form a snap-on connection. The closure cap includes a force introduction member for introducing a pulling or pushing force into the lower closure element by a force transfer member. A transition piece through which the lower closure element maintains the counter-element at a distance from the line of force of the force introduced into the lower closure element is also provided. The counter-element, when the force is applied, is elastically deflectable by the transition piece in a direction facing away from the cap casing of the closure cap.

15 Claims, 1 Drawing Sheet

SAFETY CLOSURE CAP FOR A CONTAINER

BACKGROUND OF THE INVENTION

1. Field of the Invention

This invention relates to a container closure having a lower closure element, and a closure cap placed on the pouring spout of the lower closure element, wherein the closure cap has a cover and, formed thereon, a cap casing with at least one shoulder, and wherein the lower closure element has at least one counter-element for child-proofing, which cooperates with the shoulder to form a snap-on connection.

2. Description of Prior Art

A container closure of this type is taught, for example, by German Patent Publication DE 42 09 784 C2.

In such container closures, the elasticity of a bellows connected to the pouring spout is used for forming the child-proofing. To this end, counter-elements are formed on the bellows, which counter-elements form a snap-on connection in combination with the shoulders of the closure cap. To undo this child-proofing, the closure cap, which is designed as a screw cap, must be removed from the pouring spout. This is accomplished by the user depressing the bellows in the area of the counter-elements by hand. Consequently, the counter-elements are disengaged from the shoulders and the blocking of the screw cap is released, so that it can be unscrewed from the pouring spout.

Thus, two different manipulations must be performed simultaneously to release the child-proofing, namely depressing the bellows and unscrewing the screw cap. This manipulation cannot be performed by a child, so that the material in the container is secure from unauthorized access.

SUMMARY OF THE INVENTION

It is an object of this invention to provide a container closure of the type mentioned hereinabove which can be easily operated while simultaneously preventing unauthorized access by a child.

This and other objects of this invention are attained by the closure cap having force introduction means for introducing a pulling or pushing force (F), which pulling or pushing force is introduced into the lower closure element by force transfer means. A transition piece enables the lower closure element to maintain the counter-element at a distance from the line of force of the force introduced into the lower closure element, so that the counter-element, which can be elastically displaced in respect to the shoulder, can be deflected.

A force is introduced into the closure cap by the force introduction means, for example a handle. This force, in turn, is introduced into the lower closure element. As a result, the counter-element is maintained at a distance from the line of force of the force introduced into the lower closure element and it is possible to create a torque which at the end causes the displacement of the counter-element in relation to the shoulder. The snap-on connection is, thus, released, so that the closure cap can be removed, for example unscrewed. Such a child-proofing is easily operated. It can preferably be operated using only one hand, because the pulling or pushing movement is superimposed on the removal movement of the closure cap. However, the function of securing against unauthorized access remains.

In accordance with one embodiment of this invention, the pouring spout of the lower closure element is provided with an exterior thread, which constitutes the force transfer means in combination with an interior thread of the closure cap. The transition piece, which is embodied as a circumferential ring, is elastically formed on the cylindrical pouring spout, and, in its area facing away from the pouring spout, the transition piece supports several counter-elements, which are disposed at an equal distance from each other. The closure cap is, thus, embodied as a screw cap, which can be screwed off the exterior thread of the pouring spout. Because the force transfer means are constituted by the interior thread of the closure cap and the exterior thread of the pouring spout, a space-saving construction is possible with a small expenditure. A large force can be transferred by mean of the threads. Consequently, it is also possible to adjust the required force for releasing the snap-on connection over a wide range. When introducing a pulling or pushing force into the closure cap, a torque is applied to the transition piece which causes the counter-elements to be displaced. Because the transition piece is embodied as a circumferential ring, it is possible to arrange several counter-elements, preferably distributed at equal distances over the circumference of the pouring spout. All counter-elements can be deflected at once by means of a single pulling or pushing movement.

A container closure in accordance with one embodiment of this invention comprises shoulders directed outward, away from the pouring spout, formed in one piece on the cap casing of the closure cap and disposed at equal distances over the circumference of the cylindrical cap casing. The transition piece has an upwardly pointing, circumferential collar which supports the counter-elements which, directed inward, cooperate with the shoulders. The area of the cap casing supporting the shoulders is at least partially enveloped by the collar and the pouring spout. The release of the snap-on connections between the individual shoulders and the counter-elements is, thus, preferably made possible by the entire collar being flipped away toward the outside.

However, in accordance with one embodiment of this invention, the shoulders, directed inward, facing the pouring spout, are formed in one piece on the cap casing of the closure cap and are distributed at equal distances over the circumference of the cylindrical cap casing. The transition piece has an upward directed collar which supports the counter-elements which, directed outward, cooperate with the shoulders, and the area of the collar supporting the counter-elements is at least partially enveloped by the pouring spout and the cap casing. In this case, the release of the snap-on connection is caused by the collar being displaced or pivoted toward the interior in the direction toward the center longitudinal axis of the container closure.

In accordance with another embodiment of this invention, the pouring spout and, at a distance therefrom, an elastic bellows are formed on the transition piece. Facing away from the transition piece, the bellows is connected to a ring-shaped base element into which the pouring spout can be pushed by the bellows, and the base element can be snapped in an opening of the container by means of a snap-on shoulder. Because the pouring spout is maintained at a distance from the elastic bellows by the transition piece, it is possible, when the pouring spout is displaced, to change the transition piece in respect to its position by means of the introduced force. This position change can be used for constituting or releasing the snap-on connection.

In accordance with yet another embodiment, the shoulders and/or the counter-elements are provided with inclinations slanted in the unscrewing direction, which make a transition into steep snap-on flanks, enabling screwing of the closure cap on the pouring cap without problems. Unscrewing is prevented by the steep snap-on flanks and is only possible when the shoulders are displaced in relation to the counter-elements.

In accordance with still another embodiment of this invention, the force introduction means of the closure cap are embodied as handles, which can be brought out of the non-use position into a use position. Easy handling of the container closure is also made possible by the handles. Because the handles can be pivoted out of a non-use position into a use position, opening of the closure is only possible when the handles are moved out. This offers additional security, since a child would not necessarily move the handles out.

BRIEF DESCRIPTION OF THE DRAWINGS

This invention will be explained in more detail below by means of an exemplary embodiment shown in the drawings wherein.

DESCRIPTION OF PREFERRED EMBODIMENTS

Figure 1:
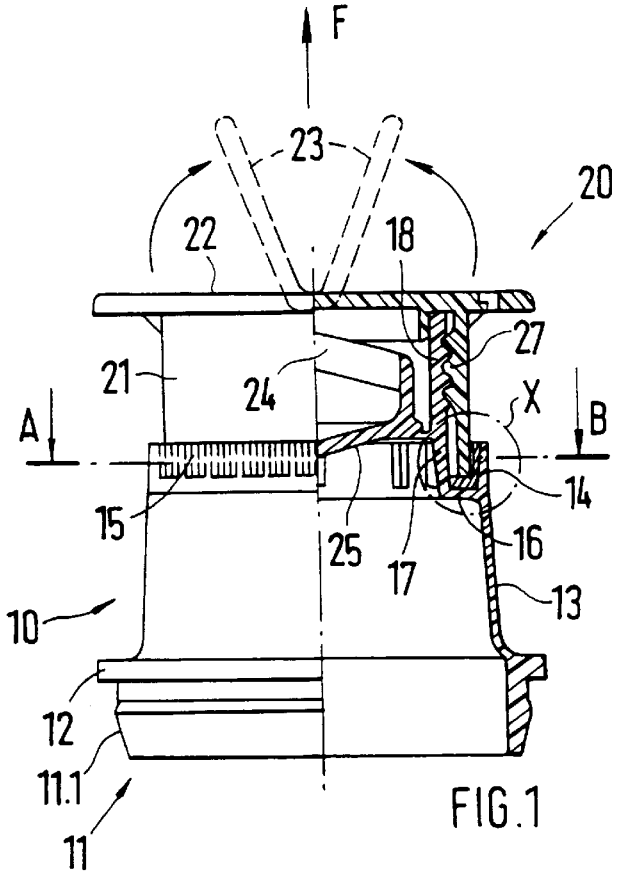
FIG. 1 is a side cross-sectional view of a container closure comprising a lower closure element and a closure cap, in accordance with one embodiment of this invention.

FIG. 1 shows a container closure comprising a lower closure element 10 and a closure cap 20 in accordance with one embodiment of this invention. The lower closure element 10 has a base element 11, which supports a snap-on shoulder 11.1. The lower closure element 10 can be snapped in an opening of a container by means of this snap-on shoulder 11.1. The insertion movement of the lower closure element into the opening is limited by flange 12, which adjoins the snap-on shoulder 11.1. With the snap-on shoulder 11.1 inserted into the opening, the flange 12 rests against the exterior of the container. A bellows 13 is formed on the flange 12, which has a pouring spout 17 on its side facing away from the base element 11. The pouring spout 17 can be pushed into the opening surrounded by the base element 11 with the aid of the bellows 13. The pouring spout 17 is provided with an exterior thread. The closure cap 20 can be screwed on the exterior thread. To this end, the closure cap 20 comprises a cap casing 21 having an interior thread. The cap casing 21 also comprises a cover 22. The cap casing 21 has two force introduction means 23 shaped in the form of handles. The force transfer means can be pivoted out of a base position, in which they form a unit with the cover 22, into a use position. The pouring spout 17 pushed into the base element 11 can be pulled up by means of the force introduction means 23. The extended position is shown in FIG. 1.

A sealing plate 25 is disposed in the pouring spout 17 to determine whether the material stored in the container is available for a first use. It is connected to the interior wall of the pouring spout 17 by predetermined breaking points. A grip 24 is provided for removing the sealing plate 25. With the closure cap 20 removed, the grip 24 is accessible, so that the sealing plate 25 can be removed.

Figure 2:
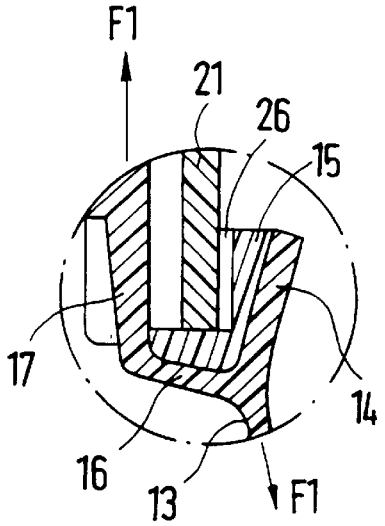
FIG. 2 is an enlarged view of the portion indicated by X in FIG. 1 in a cross-sectional view.

To provide child-proofing, an upward pointing collar 14 is formed on the bellows 13. The collar 14 comprises counter-elements 15, pointed toward the interior. Shoulders 26 are arranged on the cap casing 21 of the closure cap 20 and correspond to the counter-elements 15. The shoulders 26 face away from the pouring spout 17 and are pointed outward. This arrangement is shown in FIG. 2 in greater detail. As can be seen, the pouring spout 17 makes a transition into the bellows 13 through a transition piece 16. The transition piece 16 is embodied as a circumferential ring extending transversely in respect to the center longitudinal axis of the container closure. The upward pointing collar 14 is formed in the transition area between the transition piece 16 and the bellows 13. The collar 14 supports the counter-elements 15, which cooperate with the shoulders 26 of the cap casing 21. In the base position, the counter-elements 15 are snapped together with the shoulders 26. To release this snapped connection, a force F is introduced into the closure cap 20 by the force introduction means 23 (see FIG. 1). This force F is introduced into the cap casing 21 by the cover 22. Together with the exterior thread of the pouring spout 17, the interior thread of the cap casing 21 constitutes force transfer means 18, 27, by means of which the force F is introduced into the pouring spout 17. As FIG. 2 shows in greater detail, the force F is converted into the force F1, which acts in the pouring spout 17. This force is transferred into the bellows 13 through the transition piece 16. A torque is generated because the transition piece 16 maintains the collar 14, and therefore also the counter-elements 15, at a distance from the line of force of the force F1. This torque causes the collar 14 to flip outward, so that the counter-elements 15 are disengaged from the shoulders 26 and the snapped connection is released. The closure cap 20 can thus be screwed off the pouring spout.

The elastic material of the bellows 13 is employed for the function of child-proofing. After the force F has been received by the force introduction means 23, the collar 14 springs back into its initial position.

Figure 3:
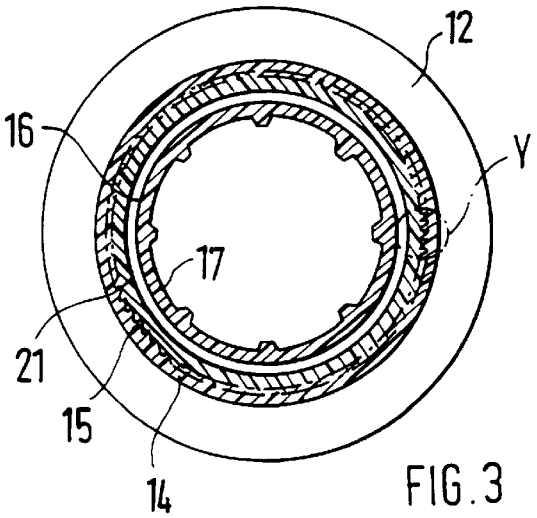
FIG. 3 is a cross-sectional plan view of the container closure shown in FIG. 1 of the plane represented by line A–B.

FIG. 3 shows the container closure of FIG. 1 in a top view along the section line A–B. As can be seen, the circularly extending collar 14 supports the counter-elements 15. They are arranged at equal distances from each other. The shoulders 26 formed on the cap casing 21 are also arranged at equal distances from each other.

Figure 4:
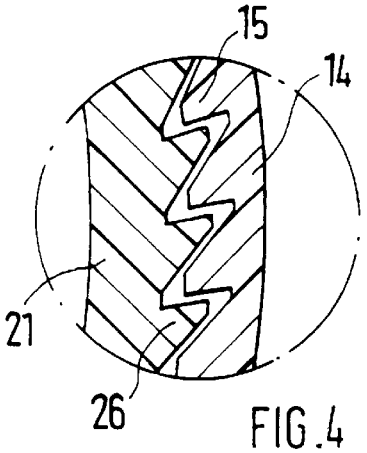
FIG. 4 is an enlarged view of the portion indicated by Y in FIG. 3 in a cross-sectional view.

A more detailed structure of the shoulders 26 and the counter-elements 15 is shown in FIG. 4. In accordance therewith, the shoulders 26 and the counter-elements 15 have deflection inclinations slanted in the unscrewing direction, which make transitions into steep snap-on flanks. During unscrewing of the screw cap the deflection inclinations slide onto each other. As a result, the counter-elements 15 are pushed outward, so that the collar 14 is laterally deflected. Screwing the screw cap off is prevented because the steep snap-on flanks rest against each other.

This invention is not limited to the embodiment shown in the exemplary embodiment. In accordance with one embodiment, the release of the snap-on connection is achieved by applying a pushing force to the force introduction means 23 of the closure cap 20. In this case, the cap casing 21 extends over the collar 14. The counter-elements on the counter 14 are, thus, outwardly pointed, and the shoulders 26 on the cap casing 21 extend toward the interior. The collar 14 flips inward when a pushing force is applied to the closure cap 20.

In accordance with yet another embodiment, the cap casing 21 has the shoulders 26 at the front. The counter-elements 15 are, thus, positioned on the transition piece 16 pointing upward. By applying a pulling force F to the force transfer means 23, the shoulders 26 are disengaged from the counter elements 15.

I claim:

1. In a container having a lower closure element and a closure cap placed on a pouring spout of the lower closure element, the closure cap having a cover and, formed thereon, a cap casing with at least one shoulder, and the lower closure element having at least one counter-element, said at least one counter-element cooperating with the at least one shoulder to form a snap-on connection, the improvement comprising:

the closure cap having a force introduction means for introducing one of a pulling and pushing force, said one of said pulling and pushing force being introduced into the lower closure element by a force transfer means, and a transition piece through which the lower closure element maintains the at least one counter-element at a distance from a line of force of the force introduced into the lower closure element, the at least one counter-element (15), when said force (F) is applied, being elastically deflectable by said transition piece (16) in a direction facing away from the cap casing (21) of the closure cap (20), the lower closure element (10) having an elastic bellows (13), a collar (14) formed on the bellows (13), the collar (14) comprising the counter-elements (15) pointed toward an interior of the collar (14), and in an extended position and a pushed-in position of the bellows (13) the at least one shoulder (26) snapped together with the at least one counter-element (15).

2. A container closure in accordance with claim 1, wherein the pouring spout (17) of the lower closure element (10) comprises an exterior thread constituting together with an interior thread of the closure cap (20) said force transfer means (18, 27), the transition piece (16), embodied as a circumferential ring, is elastically formed on the pouring spout (17), and in an area facing away from the pouring spout (17), the transition piece (16) supports a plurality of the at least one counter-element (15) disposed at an equal distance from each other.

3. A container closure in accordance with claim 1, wherein a plurality of the at least one shoulder (26) are directed outward from the pouring spout (17), formed in one piece on the cap casing (21) of the closure cap (20) and disposed at equal distances over a circumference of the cap casing (21), the transition piece (16) comprises the upwardly pointing, circumferential collar (14) which supports a plurality of the at least one counter-element (15) which, directed inward, cooperate with the shoulders (26), and an area of the cap casing (21) supporting the shoulders (26) is at least partially enveloped by the circumferential collar (14) and the pouring spout (17).

4. A container closure in accordance with claim 1, wherein a plurality of the at least one shoulder (26), directed inward facing the pouring spout (17), are formed in one piece on the cap casing (21) of the closure cap (20) and are distributed at equal distances over a circumference of the cap casing (21), the transition piece (16) comprises an upward directed circumferential collar (14) which supports a plurality of the at least one counter-element (15) which, directed outward, cooperate with shoulders (26), and an area of the circumferential collar (14) supporting the counter-elements (15) is at least partially enveloped by the pouring spout (17) and the cap casing (21).

5. A container closure in accordance with claim 1, wherein the pouring spout (17) and, at a distance therefrom, the elastic bellows (13) are formed on the transition piece (16), facing away from the transition piece (16), the bellows (13) is connected to a ring-shaped base element (11), into which the pouring spout (17) can be pushed by the bellows (13), and the base element (11) is snappable into an opening of the container by a snap-on shoulder (11.1).

6. A container closure in accordance with claim 2, wherein at least one of the at least one shoulder (26) and the at least one counter-element (15) comprise a plurality of inclinations slanted in an unscrewing direction which make a transition into a plurality of steep snap-on flanks.

7. A container closure in accordance with claim 1, wherein the force introduction means (23) of the closure cap (20) comprises two handles which are moveable out of a non-use position into a use position.

8. A container closure in accordance with claim 2, wherein a plurality of the at least one shoulder (26) are directed outward from the pouring spout (17), formed in one piece on the cap casing (21) of the closure cap (20) and disposed at equal distances over a circumference of the cap casing (21), the transition piece (16) comprises the upwardly pointing, circumferential collar (14) which supports said counter-elements (15) which, directed inward, cooperate with the shoulders (26), and an area of the cap casing (21) supporting the shoulders (26) is at least partially enveloped by the circumferential collar (14) and the pouring spout (17).

9. A container closure in accordance with claim 2, wherein a plurality of the at least one shoulder (26), directed inward facing the pouring spout (17), are formed in one piece on the cap casing (21) of the closure cap (20) and are distributed at equal distances over a circumference of the cap casing (21), the transition piece (16) comprises the upward directed circumferential collar (14) which supports said counter-elements (15) which, directed outward, cooperate with the shoulders (26), and an area of the circumferential collar (14) supporting the counter-elements (15) is at least partially enveloped by the pouring spout (17) and the cap casing (21).

10. A container closure in accordance with claim 8 wherein the pouring spout (17) and, at a distance therefrom, the elastic bellows (13) are formed on the transition piece (16), facing away from the transition piece (16), the bellows (13) is connected to a ring-shaped base element (11), into which the pouring spout (17) can be pushed by the bellows (13), and the base element (11) is snappable into an opening of the container by a snap-on shoulder (11.1).

11. A container closure in accordance with claim 9 wherein the pouring spout (17) and, at a distance therefrom, the elastic bellows (13) are formed on the transition piece (16), facing away from the transition piece (16), the bellows (13) is connected to a ring-shaped base element (11), into which the pouring spout (17) can be pushed by the bellows (13), and the base element (11) is snappable into an opening of the container by a snap-on shoulder (11.1).

12. A container closure in accordance with claim 8 wherein at least one of the shoulders (26) and the counter-elements (15) comprise a plurality of inclinations slanted in an unscrewing direction which make a transition into a plurality of steep snap-on flanks.

13. A container closure in accordance with claim 9 wherein at least one of the shoulders (26) and the counter-elements (15) comprise a plurality of inclinations slanted in an unscrewing direction which make a transition into a plurality of steep snap-on flanks.

14. A container closure in accordance with claim 12 wherein the force introduction means (23) of the closure cap (20) comprises two handles which are movable out of a non-use position into a use position.

15. A container closure in accordance with claim 13 wherein the force introduction means (23) of the closure cap (20) comprises two handles which are movable out of a non-use position into a use position.

* * * * *